US007126074B1

(12) United States Patent
Berceli

(10) Patent No.: US 7,126,074 B1
(45) Date of Patent: Oct. 24, 2006

(54) METHOD FOR SORTING A GROUP OF OBJECTS

(75) Inventor: Georg Berceli, Budapest (HU)

(73) Assignee: WF Logistik GmbH, Landsberg (DE)

( * ) Notice: Subject to any disclaimer, the term of this patent is extended or adjusted under 35 U.S.C. 154(b) by 0 days.

(21) Appl. No.: 10/049,431

(22) PCT Filed: Jul. 28, 2000

(86) PCT No.: PCT/EP00/07313

§ 371 (c)(1),
(2), (4) Date: Feb. 12, 2002

(87) PCT Pub. No.: WO01/12347

PCT Pub. Date: Feb. 22, 2001

(30) Foreign Application Priority Data

Aug. 13, 1999 (DE) ..... 199 38 470

(51) Int. Cl.
*B07C 5/00* (2006.01)

(52) U.S. Cl. ..... 209/583

(58) Field of Classification Search ..... 209/583, 209/584, 656, 651, 652, 657, 900
See application file for complete search history.

(56) References Cited

U.S. PATENT DOCUMENTS

| | | | | |
|---|---|---|---|---|
| 4,388,994 | A * | 6/1983 | Suda et al. | 209/564 |
| 4,566,595 | A * | 1/1986 | Fustier | 209/545 |
| 5,072,822 | A * | 12/1991 | Smith | 198/349 |
| 5,238,122 | A * | 8/1993 | Hart | 209/555 |
| 5,377,814 | A * | 1/1995 | Smith et al. | 198/465.4 |
| 5,687,851 | A | 11/1997 | Schoenenberger et al. | |
| 6,373,012 | B1 * | 4/2002 | Crutchfield et al. | 209/584 |

FOREIGN PATENT DOCUMENTS

| | | |
|---|---|---|
| DE | 4226066 | 2/1994 |
| EP | 0661106 | 7/1995 |
| EP | 0697260 | 2/1996 |

* cited by examiner

*Primary Examiner*—Donald P. Walsh
*Assistant Examiner*—Joseph Rodriguez
(74) *Attorney, Agent, or Firm*—Rothwell, Figg, Ernst & Manbeck

(57) ABSTRACT

A sorting method and apparatus which permits a high sorting speed during the sorting of a group of objects is disclosed. The method and apparatus can be carried out automatically and with simple equipment in some preferred embodiments.

7 Claims, 2 Drawing Sheets

METHOD FOR SORTING A GROUP OF OBJECTS

BACKGROUND

The invention relates to a sorting method and a sorting device for carrying out the sorting method.

For sorting methods and sorting devices of the type considered here and relevant to the prior art, reference can be made for example to DE 42 26 066 A1 and EP 0 755 355 B1.

SUMMARY

The invention is based on the object of providing a sorting method which permits a high sorting speed during the sorting of a group of objects and which can be carried out automatically with simple equipment.

In order to achieve this object, a method is proposed for sorting a group of objects in accordance with an ascending sequence or a descending sequence of order numbers which are assigned to the objects, the objects being subjected in successive sorting steps to a sorting treatment in that, depending on the sorting criterion as to whether the order number of the respective object has or would have a zero or a one in its binary representation at a point that depends on the relevant sorting step, it is allocated to a respective first storage area or a respective second storage area for sorting treatment in the next sorting step, the least significant digit of the order number in the binary representation being relevant for the sorting criterion in the first sorting step and the respective next most significant digit in the order number in the binary representation being relevant for the sorting criterion in the successive further sorting steps, and, beginning at the second sorting step, either firstly all the objects from the respective first storage area and then the objects from the respective second storage area or firstly all the objects from the second storage area and then the objects from the first storage area—maintaining the relevant storage area sequence for all further sorting steps—being subjected to the sorting treatment, specifically, beginning at the latest from the third sorting step, in the sequence in which the objects were supplied to the respective storage area in the preceding sorting step.

The sorting method according to the invention may be automated in a simple way and by means of an appropriately adapted conveying device, for example a suspension conveying device. In the case of such conveying devices, the objects are located on conveyed goods carriers, which serve as transport means and which are moveably guided along relevant guide rails. The conveyed goods carriers are normally driven to move along the guide rails by means of drive belts or the like, it being possible for them to be accumulated as desired in accumulation areas, which can be used as storage areas.

A sorting device is also proposed for sorting objects in accordance with the method as claimed by the invention, the sorting device being part of a conveying device, in particular a suspension conveying device, in which conveyed goods carriers are moved and guided on guide elements, in particular guide rails, along relevant conveying paths, as transport means for the objects, the sorting device comprising the following features:

a first conveying path section to be used as a first destination storage area and a second conveying path section to be used as a second destination storage area for the intermediate storage of objects located on conveyed goods carriers during a respective sorting step in accordance with the sorting criterion relevant in the sorting step, as specified in claim 1, a conveying path section to be used as a first source storage area and a second conveying path section to be used as a second source storage area for providing the objects located on conveyed goods carriers for sorting treatment during a respective sorting step, at least one diverter device between the source storage areas and the destination storage areas, a control device for controlling the supply of conveyed goods carriers to the diverter device and for controlling the diverter position of the diverter device in such a way that, during a sorting step, the objects from one of the relevant two source storage areas and then the objects from the other source storage area are successively routed to the relevant first destination storage area or to the second destination storage area, in accordance with the sorting criterion relevant in the respective sorting step, at least one data reading device, provided close to the diverter device, for registering order numbers, preferably provided in machine-readable form on the conveyed goods carriers, of objects which are supplied to the diverter device, the data reading device outputting order number information to the control device.

The sorting device can be implemented with simple equipment, it normally being possible for known components from the area of conveying technology to be used to construct a sorting device as claimed by the invention.

The source storage areas and the destination storage areas are preferably conveying path areas of conveying circuits, which are connected to one another via the diverter device W. In an embodiment of a sorting device as claimed by the invention, described further below with reference to FIG. 2, a single conveying circuit is sufficient, having a bridging branch with the effect of a bypass path between two node points, the diverter device being provided at a node point.

There are numerous further conveying circuit architectures for implementing a sorting device by means of which the method as claimed by the invention can be carried out. During the configuration of the conveying circuits, care should preferably be taken that the destination storage areas from the preceding sorting step are or can become source storage areas for the next following sorting step, or that the objects from the destination storage areas can be transferred in order into relevant source storage areas for the next following sorting step.

If the original group of objects to be sorted should be too large for the capacity of the sorting device used, then, in the method according to the invention, the obvious course is to divide the original group, repeatedly if necessary. Should a single division of the group be sufficient, then the aim is approximate halving. The original group can be divided in that, in a preparation step, all the objects with an order number greater than a predetermined number are allocated to a first subgroup, and the remaining objects from the original group are allocated to a second subgroup. The subgroups are then sorted one after another in accordance with the method as claimed in claim 1. Finally, the individually sorted subgroups can be combined in order, so that all the original objects are combined in order in accordance with an ascending sequence of order numbers.

In the case of the method as claimed by the invention, it is not necessary for all the order numbers to be present without gaps. Furthermore, it is entirely permitted for order numbers to be allocated repeatedly. In the latter case, the objects with the same order number will be located immediately adjacent to one another after sorting.

BRIEF DESCRIPTION OF THE DRAWINGS

The invention will be explained in more detail below using the figures.

DESCRIPTION OF THE PREFERRED EMBODIMENTS

Figure 1:
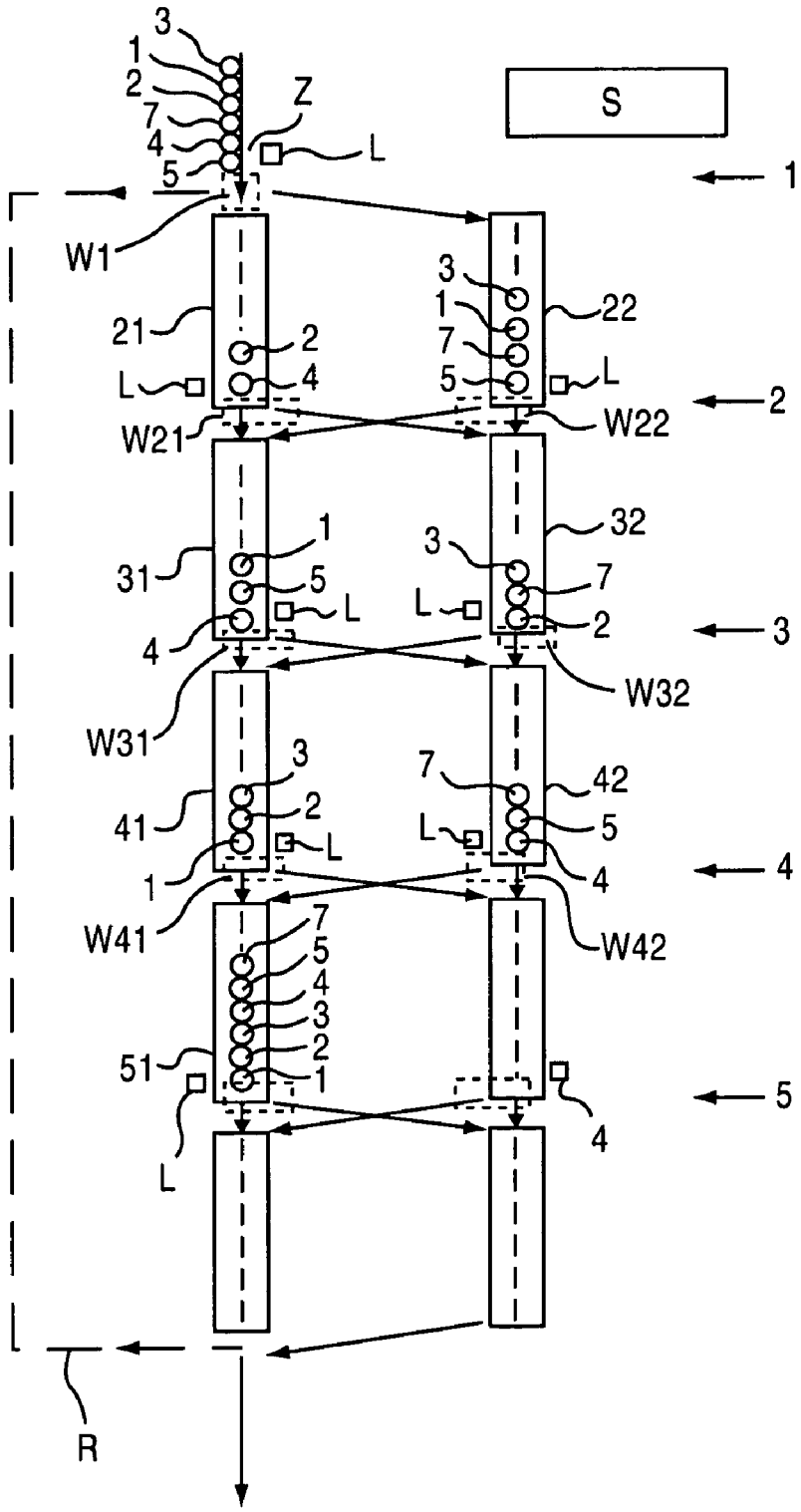
FIG. 1 shows a block diagram to explain one variant of the method according to the invention.

One possible way of carrying out the sorting method according to the invention will be explained by using the block diagram in FIG. 1. For the example, let it be assumed that six objects are to be sorted in ascending sequence of their order numbers, these six objects being supplied in a random or arbitrary sequence corresponding to the order numbers 5, 4, 7, 2, 1, 3 to the sorting device, sketched schematically, via a supply conveying path Z. In the figures, the objects are represented as circles and identified by their order number. Let it be assumed that each object can be moved through the sorting device along relevant conveying paths on its own conveyed goods carrier. Assume that the respective order number is provided in machine-readable form, for example in barcode form, on the respective conveyed goods carrier, so that the opto-electronic reader L, which is arranged immediately upstream of an input diverter W1, can register the order numbers of the objects led past the reader L in order. The reader L passes on the information read to a control device S, this control device preferably comprising a microcomputer for controlling the individual sorting steps further explained below. In the first sorting step, the control device controls the input diverter W1 in accordance with the order number read by the reader L from the respective next object which is supplied to the diverter. The criterion for the respective setting of the diverter W1 is the $2^0$ bit in the binary representation of the respective order number. If the $2^0$ bit, that is to say the least significant digit in the binary representation of the order number is equal to 0, then the diverter W1 controlled by the control device S lets the relevant object through to the first storage area 21. By contrast, if the $2^0$ bit of the order number of the object next supplied to the diverter W1 is equal to 1, then the diverter W1 lets the object through to the second storage area 22. After all the objects have run through the input diverter W1, the first sorting step has been completed. In the example, the objects with the order numbers 4 and 2 are then located in the first storage area 21, and the objects with the order numbers 5, 7, 1 and 3 are located in the second storage area 22. The first sorting step has therefore effected division of the original group of objects into a group with even-numbered order numbers and into a group with odd-numbered order numbers.

The second sorting step begins with the articles from the first storage area 21 being supplied to the diverter W21. Depending on whether the order number of the respective objects supplied to the diverter W21 has a zero or a one in the penultimate digit in the binary representation, that is to say whether the $2^1$ bit is equal to 0 or 1, the diverter W21 lets the objects through to the following first storage area 31 or to the following second storage area 32. In the example, this means that the object with the order number 4, which has a zero in the penultimate digit in the binary representation, passes to the first storage area 31, while the object with the order number 2, which has a one in the penultimate digit in the binary representation, passes to the second storage area 32. As soon as all the objects from the original first storage area 21 have passed the diverter W21, the original second storage area 22 has been treated, in that the objects stored therein have been supplied via the diverter W22 to the following first storage area 31 or the following second storage area 32. This sorting treatment of the original second storage area 22 further belongs to the second sorting step, in which, as before, the penultimate digit, that is to say the $2^1$ bit, in the binary representation of the respective order number is relevant for the sorting decision. Of the objects with the order numbers 5, 7, 1, 3 from the original second storage area 22, the objects 5 and 1 pass into the first storage area 31, since their order numbers have a zero at the penultimate digit in the binary representation, while the objects with the order numbers 7 and 3 have been guided into the second storage area 32, since their order numbers have a one at the penultimate digit in the binary representation. After all the objects from the original second storage area 22 have been subjected to the sorting treatment in the manner described, the second sorting step has been completed.

The starting situation for the third sorting step which now follows is represented thus: the objects with the order numbers 4, 5 and 1 are located in the current first storage area 31. The objects with the order numbers 2, 7, 3 are located in the current second storage area 32. The storage areas 31 and 32 used as destination storage areas for the second sorting step are now the source storage areas for the third sorting step. The third sorting step is carried out in an analogous way to the second sorting step, in that first all the objects from the first storage area 31 are subjected to a sorting treatment by means of the diverter W31, before all the objects from the second storage area 32 are then subjected to the sorting treatment by means of the diverter W32. For the sorting criterion, the third last digit, that is to say the $2^2$ bit, in the binary representation of the order number is then used. All the objects in which the order number in the binary representation have a zero in the third last digit, pass into the following first storage area 41, while the remaining objects, in which the order number has a one in the third last digit, are introduced into the following second storage area 42. In this third sorting step, the objects from the first storage area 31 and then the objects from the second storage area 32 are in each case subjected to the sorting treatment following the order in which they were introduced into the relevant storage area. In the example, the third sorting step therefore proceeds as follows: the objects with the order numbers 4 and 5 pass one after another into the second storage area 42, before the object with the order number 1 is then guided into the first storage area 41. Then, the object with the order number 2 comes into the first storage area 41. The object with the order number 7 is guided into the second storage area 42. Finally, the object with the order number 3 passes into the first storage area 41. After this third sorting step, the objects with the order numbers 1, 2 and 3 are therefore located in the first storage area 41, while the objects with the order numbers 4, 5 and 7 are to be found in the second storage area. In the example, the objects in the individual storage areas 41 and 42 are already present in the correct ascending sequence of their order numbers. There therefore remains only the step of combining the objects from the two storage areas 41 and 42 in order. This can be done in a fourth sorting step, which is carried out in a manner completely analogous to the third sorting step, by means of the diverters W41 and W42, the fourth last digit of the order number in the binary representation being considered as the sorting criterion in the fourth step. In the fourth step, too, again the first storage area (in this case the storage area 41) is treated first, the objects being sorted in the sequence in which they were introduced into the first storage area 41 in the preceding third sorting step. Then, the objects from the second storage area 42 are treated in a corresponding way. Since none of the objects has an order number which has a one at the fourth last digit, the objects pass into the storage area 51, specifically in the sequence of ascending order numbers. Therefore, the group of objects originally supplied to the sorting device in the order number sequence 5, 4, 7, 2, 1, 3 has been sorted in the manner desired.

The control of the diverters W21, W22, W31, W32, W41, W42 and, if necessary, further diverters is carried out by means of the control device S. Each of the last-named diverters can be assigned a respective reader L, which communicates the respective order number of the next object supplied to the relevant diverter to the control device, so that the control device S can use the diverter in accordance with the order number or in accordance with the sorting criterion to be applied to the order number in the respective sorting step. Since the sorting device and the sorting method carried out with it as claimed by the invention form a deterministic system, the control device S can in principle calculate the respective desired occupancy of the storage areas in association with each sorting step in advance, if the sequence of the order numbers of the group of objects originally introduced was registered for the control device, for example by using the reader L which is connected upstream of the input diverter W1. In such a system, the readers L assigned to the further diverters W21, W22, W31, . . . could in principle be dispensed with, since, by means of the control device S, it is possible to calculate for each sorting step which object is next supplied to the diverter currently to be driven during the processing of the respective storage areas, taking account of the sequence described above. In the case of such a procedure, it is assumed that the desired state respectively calculated by means of the control device always corresponds to the actual current state during the occupancy of the storage areas.

Were the current state to deviate from the desired state on account of a sorting error of any type whatsoever, then without actual checking of the order numbers of the objects supplied to the relevant diverters, by means of relevant readers L, the procedure mentioned last would lead to an erroneous sorting result. It is therefore more advantageous to read in the order number of each object supplied to a relevant diverter, in order to control the diverter in accordance with the sorting criterion in the respective sorting-step. If appropriate, the order number read in can be compared with a respective order number calculated by the control device in the manner described above, in order to monitor the correct operation of the sorting device. If a discrepancy occurs between the calculated desired order number and the current order number read in, then this is an indication that a sorting error has occurred. Such a sorting error can occur, for example, if an object inadvertently falls out of the conveyor system forming the sorting device or is derailed and is then introduced into the conveying system again, but at an arbitrary point. If, during a relevant comparison between the current state and the desired state, the control device determines that there is a discrepancy when supplying the objects to a respective diverter, then it can, for example, trigger an alarm signal and/or carry out a corrective operation, for example in the form of the repetition of sorting steps already carried out, in order to eliminate the sorting error. In FIG. 1, R designates a return output path which, in the event of a sorting error, permits the entire group to be fed back for renewed sorting.

For reasons of clarity, a group of only six group members with six different order numbers was considered in the example according to FIG. 1. Of course, the group of objects to be sorted in each case can be considerably larger, and the range of (integer) order numbers can be expanded considerably; the order numbers should lie in the range between 0 and $2^N-1$, where N specifies the number of sorting steps.

According to the illustration in FIG. 1, it could be assumed that a new pair of destination storage areas Wx1, Wx2 is made available for each sorting step, and then serves as a pair of source storage areas for the next following sorting step. According to a preferred refinement of a sorting device as claimed by the invention, access is made again and again in a recurrent way to physically the same pairs of storage areas, in order to carry out the sorting method up to the desired ordering level of the objects. Such a procedure will be explained below with reference to FIG. 2.

Figure 2:
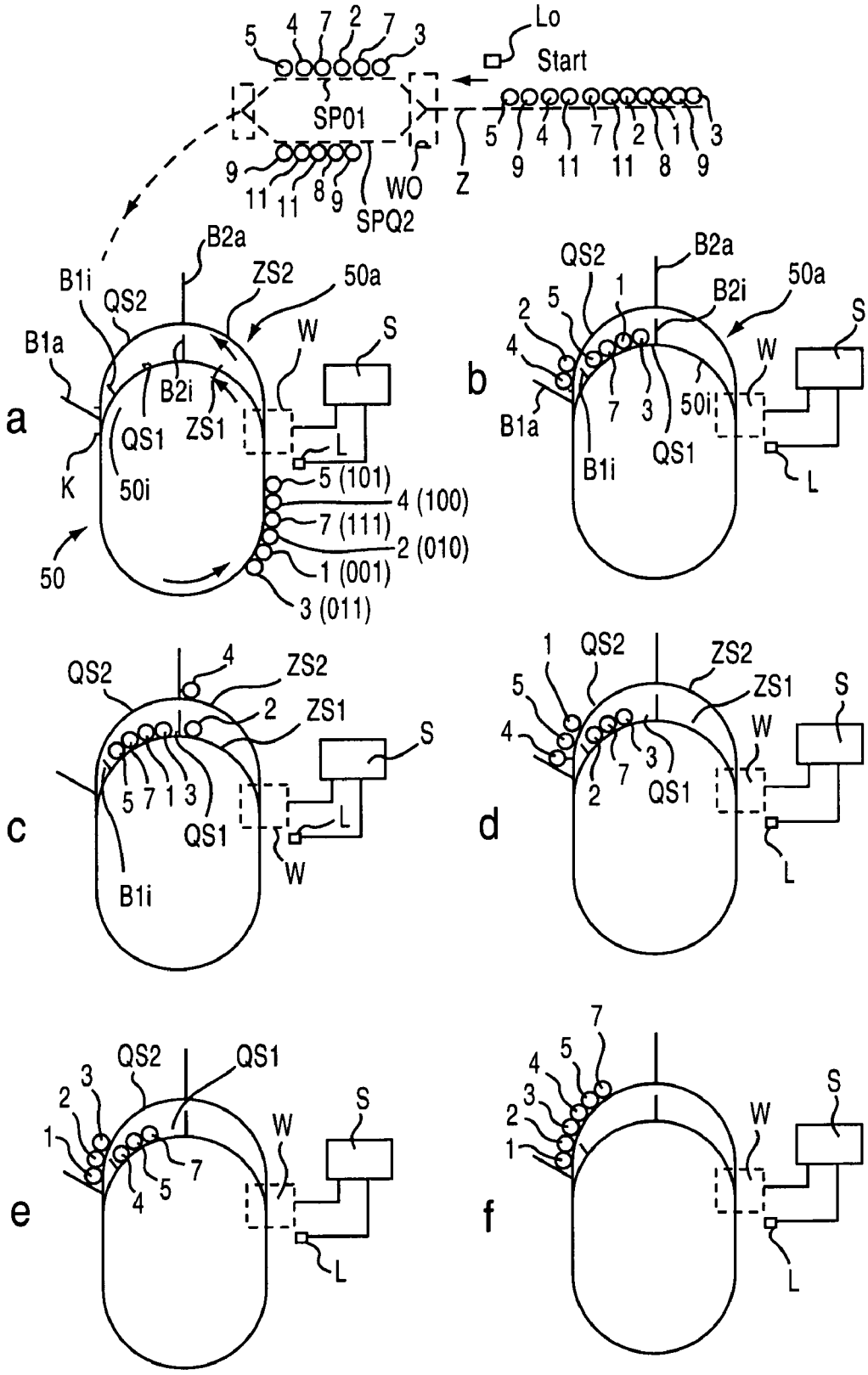
FIG. 2 shows, in a very schematic illustration, a sorting device according to the invention during various stages in the processing of a sorting task.

FIG. 2 shows an example of a sorting conveying circuit according to the invention for a conveying device, in particular a suspension conveying device, in a highly schematic representation during various stages in the processing of a sorting task.

For the purposes of explanation, let it be assumed that a group of objects with the order numbers 5, 9, 4, 11, 7, 11, 2, 8, 1, 9, 3 are present in sequence in the above enumeration and are to be sorted, so that the objects are finally ordered in the ascending sequence of their order numbers.

In a sorting preparation step, the objects are supplied one after another via the supply path Z to a diverter W0 controlled by a control device S. The diverter W0 is controlled in such a way that it lets all the objects with an order number <8 through to a first preparation store SP0L, while all the objects with an order number ≧8 are supplied to a second preparation store SP02. Such a division, in particular approximate halving, of the original group is expedient in the case of a large number of objects to be sorted in the original group, in order to manage with comparatively small and to some extent more comprehensible storage area capacities for the further sorting sequence. The control device S receives from the reader L0 the information about the order number of the object respectively supplied to the diverter W0 next. To this end, let it be assumed that each object is carried by a conveyed goods carrier, which has the order number of the object in machine-readable form for automatic reading by means of the reader L.

After this sorting preparation step, the objects with the order numbers 5, 4, 7, 2, 1, 3 are located in the first preparation store SP01, while the objects with the order numbers 9, 11, 11, 8, 9 are stored in the preparation store SP02 in the appropriate sequence of the order numbers. In the sorting method, then, firstly the objects from the first preparation store SP01 are incorporated in order, these objects being supplied to the conveying circuit 50, so that the result is the situation a) according to FIG. 2.

The conveying circuit 50 has an internal bridging branch 50*i*, which originates from a diverter W that can be controlled by the control device S and leads to the node point K, so that, in accordance with the circulation direction of the conveying circuit, indicated by arrows, conveyed goods carriers moved to the diverter W, together with their objects, can be guided either into the inner bridging path 50*i* or into the outer conveying path 50*a* in accordance with the position of the diverter W. A reader L is connected upstream of the diverter W with the effect that it can read the order number of the next following object supplied to the diverter from the conveyed goods carrier of said object, in order to provide the order number information for the control device S, which then controls the position of the diverter W on the basis of the respective order number in accordance with the sorting criterion assigned to the respective sorting step. In addition, a device for separating the objects can be provided upstream of the diverter W.

Both in the inner bridging path 50*i* and in the outer conveying path 50*a*, stop elements B1*i*, B2*i* and, respectively, B1*a*, B2*a* are provided. The stop elements can be moved under control between a blocking position and a releasing position. The control of the individual stop elements is carried out by means of the control device S. In the blocking position, a relevant stop element reaches into the conveying path of the conveyed goods carriers, in order to prevent conveyed goods carriers traveling onward. In the releasing position, a relevant stop element is removed from the respective conveying path. In the event that a relevant conveying path is blocked, be it in the bridging path 50*i* or in the outer conveying path 50*a*, a backlog of conveyed goods carriers can form behind the blocking stop element. As soon as the respective stop element has then been changed to the releasing position, the backlog can be released.

Between the stop elements B1*i* and B2*i*, a first source storage area QS1 is provided in the bridge path 50*i*. A first destination storage area ZS1 is located between the stop element B2*i* and the diverter W. Between the stop element B1*a* and the stop element B2*a*, a second source storage area QS2 is defined, while a second destination storage area ZS2 is provided between the stop element B2*a* and the diverter W.

Starting from the starting situation a) in FIG. 2, the first sorting step is then carried out. In the process, the diverter W lets all the objects with an odd order number, namely the objects with the order numbers 5, 7, 1, 3 in the example, through to the first destination storage area ZS1. The objects with the even order numbers, namely the objects with the order numbers 4, 2 in the example, are routed by the diverter W to the second destination storage area ZS2. The stop elements B2*i* and B2*a* are still in the blocking position, until all the objects with their conveyed goods carriers have passed the diverter W. The control device S then causes the stop elements B2*i* and B2*a* to transfer to the releasing position, so that the respective objects can pass from the destination storage area ZS1 or ZS2 into the adjacent source storage area QS1 and QS2. After that, the situation b) according to FIG. 2 is finally present at the end of the first sorting step, all the stop elements B1*a* and B2*a* and B1*i* and B2*i* being in the blocking position.

The least significant digit of the respective order number in the binary representation, that is to say the $2^0$ bit, was relevant for the sorting criterion of the first sorting step. In the example, after the completion of the first sorting step, all the objects with an order number which, in the binary representation, has a zero at the least significant digit, are located in the second source storage area QS2. These are the objects with the even-numbered order numbers 4 and 2. The objects with order numbers which have a one at the least significant digit in their binary representation, that is to say the objects with odd-numbered order numbers, are located in the first source storage area QS1 after the completion of the first sorting step.

In the second sorting step, being carried out starting from the situation b) according to FIG. 2, the penultimate digit of the respective order number in the binary representation is relevant for the sorting criterion. The second sorting step is initiated by the stop element B1*a* being transferred to the releasing position, so that the objects with the order numbers 4 and 2 are supplied one after another to the diverter W. In accordance with the current sorting criterion in the second sorting step, the control device S controls the diverter in such a way that the object with the order number 4, which has a zero at the penultimate digit in the binary representation, passes into the second destination storage area ZS2, while the object with the order number 2, which has a one at the penultimate digit in the binary representation, is routed to the first destination storage area ZS1. After that, the situation c) according to FIG. 2 is present. There then follows the sorting treatment of the objects located in the source storage area QS1 and having the order numbers 5, 7, 1, 3. To this end, the stop element B1*i* is put into the releasing position, so that the objects are transported to the diverter W. The sorting criterion of the second sorting step still applies, so that the object with the order number 5 passes into the storage areas ZS2, after which the object with the order number 7 is guided into the storage area ZS1. The object with the order number 1 comes into the storage area ZS2 again, while the object with the order number 3 is routed into the storage area ZS1. After all the objects have then passed the diverter W in the second sorting step, the stop elements B2*i* and B2*a*, normally located in the blocking position, are switched into the releasing position by the control device S, so that the objects from the destination storage area ZS2 pass into the source storage area QS2, and the objects from the destination storage area ZS1 pass into the source storage area QS1. The second sorting step has therefore then been concluded and, in the example, the situation d) according to FIG. 2 is present.

The third sorting step then follows in an analogous way to the preceding sorting steps, the third last digit of the order numbers in the binary representation, that is to say the $2^2$ bit now being relevant for the sorting criterion. In this case, in the predefined sequence, first the objects from the source storage area QS2 are subjected to the sorting treatment in order, after which the objects from the source storage area QS1 are then supplied to the sorting treatment. Situation e) according to FIG. 2 represents the sorting state after the completion of the third sorting step. After the completion of the fourth sorting step, which again is carried out in a manner analogous to the preceding sorting steps and in which the fourth last digit in the order number in the binary representation, that is to say the $2^3$ bit, is then relevant, the situation f) according to FIG. 2 is present. The objects have been sorted in ascending sequence of their order numbers and can then be taken out of the conveying circuit 50 in order and, for example, fed to an output store.

After that, the objects with the order numbers 9, 11, 11, 8, 9 from the preparation store SP02 are supplied to the conveying circuit 50 and subjected to the sorting method, until all the objects with the order numbers 8, 9 and 11 are present in the desired sequence. The objects ordered in this way can then be transferred to the output store, in which all the objects from the original group are then present in the correct sequence of the order numbers 1, 2, 3, 4, 5, 7, 8, 9, 9, 11, 11. The descending sequence would have been achieved if, in each sorting step, access had been made first to QS1 and then to QS2.

The exemplary embodiments explained show that the sorting method as claimed by the invention can be carried out with a continuous forward flow of the objects, that is to say it is not necessary for the objects to carry out forward/backward journeys. This brings with it not only advantages in terms of drive but also in particular time advantages during sorting, so that a comparatively high sorting speed can be achieved.

The exemplary embodiments described also show that the sorting method according to the invention can be carried out with sorting devices of different designs, it being possible in particular for a conveying circuit of the type shown in FIG. 2 to be implemented with few elements. In addition, in the example according to FIG. 2, it is possible for the control device S to compare the current sorting state with the desired sorting state continually and, upon the occurrence of an error, to control the sorting method in such a way that sorting steps are repeated, if necessary starting with the first sorting step, in order to eliminate the sorting error.

With the technical teaching disclosed in the present application, it should be possible for those skilled in the art to provide further conveying circuit architectures with which the sorting method as claimed by the invention can be carried out.

It is pointed out that the sorting criterion of bit-wise interrogation can, if necessary, be formulated by various alternative mathematical representations which, given the same conditions, lead to the same physical sorting sequence and sorting effect and are therefore covered by the invention. The following examples illustrate this.

If it is intended to determine whether the least significant digit of an order number has a zero or a one in the binary representation, then this can alternatively also be done, for example, by the order number (as a natural number) in the range of natural numbers being divided by 2 and the resulting remainder being used as a sorting criterion. In this regard, for example, consider the decimal number 7. In the binary representation, this is: 0111. The least significant bit is therefore a one.

If the number 7 is divided by 2, then the result is 3, remainder 1. This remainder 1 is then the sorting feature to be distinguished. For comparison:

The number 6 is 0110 in binary representation. The least significant bit is therefore 0. If the number 6 is divided by 2, then the result is the value 3, remainder 0. The remainder 0 is again the distinguishing feature for the first sorting step. The bit interrogation and the remainder interrogation are therefore two equivalent representations of one and the same physical fact and are therefore two mutually corresponding representations of the sorting criteria used in the invention.

Such a consideration of the remainder, as an alternative representation of the sorting criterion, is also possible with reference to the most significant bit positions of order numbers represented in binary form. For example, it can easily be shown that an order number which, when divided by 4, results in a remainder of 0 or 1, has a zero at the second least significant bit, that is to say the $2^1$ bit, in the binary representation. If there is a remainder of 2 or 3 in the case of division by 4, then the $2^1$ bit has a one. Thus, instead of the immediate interrogation of the $2^1$ bit in the binary representation, the corresponding sorting criterion can alternatively be represented by dividing the order number by 4 and by correspondent distinction in accordance with the remainders.

If it is wished to know whether an order number has a zero or a one in its third least significant digit, that is to say the $2^2$ bit, then the order number can be divided by 8 for this purpose. If the result is a remainder of 0, 1, 2 or 3 (lower half of the value range of the possible remainders of 0, 1, 2, 3, 4, 5, 6, 7), then the bit value 0 is present at the third least significant digit. If the result is a remainder of 4, 5, 6 or 7 (upper half of the value range), then the bit value 1 is present at the third least significant digit.

This can be continued systematically in the manner explained by means of division by 16, 32, 64, . . . corresponding to the next more significant bit considered in each case and by means of distinction in accordance with the resulting remainders, the remainders from the lower half of the value range corresponding to the binary "zero" and the remainders from the upper half of the value range of possible remainders corresponding to the binary "one".

What is claimed is:

1. A method of sorting a group of objects in accordance with an ascending sequence or a descending sequence of order numbers assigned to each of the objects, by performing a sequence of successive sorting steps, said method comprising steps of:

providing a pair of first and second storage areas for each sorting step of said sequence of successive sorting steps, each pair of first and second storage areas serving as separate source storage areas for subsequent steps;

for each object, determining whether a binary representation of the order number for the object has a zero or a one at a digit point in the binary representation based on a current sorting step, the digit point being a least significant digit of the binary representation for the first sorting step of said successive sorting steps, and for each next sorting step, the point being the respective next most significant digit in the binary representation; and allocating each object to the first storage area or the second storage area corresponding to the current sorting step based upon the result of the determining step;

wherein, for each sorting step from the second sorting step on, the determining step and allocating step are performed for each object sequentially either beginning with objects in the first storage area corresponding to the previous step, and next performing the determining step and allocating step for all the objects in the second storage area corresponding to the previous step objects, or beginning with objects in the second storage area corresponding to the previous step, and next performing the determining step and allocating step for all the objects in the first storage area corresponding to the previous step objects.

2. The method as claimed in claim 1, further including:

at least one preparation step of subdividing the group of objects into a first group of objects whose order number is less than a relevant predetermined number, and into a second group of objects whose order number is equal to or greater than the predetermined number, and a step of sorting each subgroup.

3. The method as claimed in claim 2, further including a step of combining the subgroups in order after being sorted.

4. The method as claimed in claim 1, further including providing a plurality of said first storage areas (21, 31, 41 . . . ) aligned end-to-end and a plurality of said second storage areas (22, 32, 42 . . . ) aligned end-to-end so that said successive sorting steps are carried out in different storage areas arranged in end-to-end relationships.

5. The method as claimed in claim 4, further including providing said plurality of said first storage areas (21, 31, 41 . . . ) aligned end-to-end in a generally linear relationship and said plurality of said second storage areas (22, 32, 42 . . . ) aligned end-to-end in a generally linear relationship so that said successive sorting steps are carried out along a generally linear path.

6. A sorting device for sorting objects in accordance with the method as claimed in claim 1, the sorting device being part of a suspension conveying device in which conveyed goods carriers are moved and guided on guide rails along relevant conveying paths as transport means for the objects, the sorting device comprising:

a first pair of conveying path sections corresponding to first and second source storage area (QS1, QS2) corresponding to a first step in the sorting method;

a second pair of conveying path sections corresponding to first and second storage areas (ZS1, ZS2) for a second sorting step in the sorting method;

at least one diverter device (W) between the second pair of storage areas (QS1, QS2) and the first pair of storage areas (ZS1, ZS2), at least one data reading device (L), provided close to the diverter device (W) for registering order numbers of objects which are supplied to the diverter device (W); and a control device (S) that receives order number information from the data reading device (L), controls the supply of the conveyed goods carriers to the diverter device (W), and controls the diverter position of the diverter device (W) to allocate the objects from the first pair of storage areas (QS1, QS2) to the second pair of storage areas (ZS1, ZS2) based upon the order number information, in accordance with the determining and allocating steps of the method.

7. The sorting device as claimed in claim 6, wherein the second pair of storage areas (ZS1, ZS2) and the first pair of storage areas (QS1, QS2) are provided in conveying circuits (50*i*, 50*a*) which are connected to one another via the diverter device (W).

* * * * *